US012146326B2

(12) United States Patent
Sighinolfi

(10) Patent No.: US 12,146,326 B2
(45) Date of Patent: Nov. 19, 2024

(54) TOOL FOR THE APPLICATION OF PRESSING WEDGES

(71) Applicant: RAIMONDI S.P.A., Modena (IT)

(72) Inventor: Riccardo Sighinolfi, Rubiera (IT)

(73) Assignee: RAIMONDI S.P.A., Modena (IT)

( * ) Notice: Subject to any disclaimer, the term of this patent is extended or adjusted under 35 U.S.C. 154(b) by 500 days.

(21) Appl. No.: 17/499,968

(22) Filed: Oct. 13, 2021

(65) Prior Publication Data

US 2022/0112730 A1 Apr. 14, 2022

(30) Foreign Application Priority Data

Oct. 13, 2020 (IT) ..... 102020000024103

(51) Int. Cl.
*E04F 21/00* (2006.01)
*E04F 21/18* (2006.01)
*E04F 21/22* (2006.01)

(52) U.S. Cl.
CPC ..... *E04F 21/0092* (2013.01); *E04F 21/1877* (2013.01); *E04F 21/22* (2013.01)

(58) Field of Classification Search
CPC .... E04F 21/0092; E04F 21/1877; E04F 21/22
See application file for complete search history.

(56) References Cited

U.S. PATENT DOCUMENTS 5,038,490 A * 8/1991 Armstrong ..... E04F 21/20 33/562
6,386,532 B1 * 5/2002 Donovan ..... B25B 5/061 269/25
8,919,076 B1 * 12/2014 Kitchens ..... E04F 21/0092 52/749.11
10,988,944 B2 * 4/2021 Li ..... B25B 7/14
11,661,752 B2 * 5/2023 Li ..... B25B 7/02 52/126.1
2015/0027082 A1 * 1/2015 Hoffman ..... E04F 21/1877 52/749.11
2019/0309531 A1 * 10/2019 Li ..... B25B 7/22
(Continued)

FOREIGN PATENT DOCUMENTS

CN 204983579 U * 1/2016
CN 107514126 A * 12/2017
(Continued)

*Primary Examiner* — Yaritza Guadalupe-McCall
(74) *Attorney, Agent, or Firm* — FISHERBROYLES, LLP

(57) ABSTRACT

A tool for the application of pressing wedges in wedge-type levelling spacer systems used in the application of tiles and that are equipped with a base block and a pressing wedge. The tool includes a handgrip from a front end of which projects a support rod having a longitudinal axis, a slider constrained to the support rod and at least partially delimiting a through opening configured to slidably receive at least one axial segment of the pressing wedge, a thruster associated with the handgrip in a movable manner at least along a thrusting direction parallel to the longitudinal axis of the support rod between an advanced position, wherein the thruster is proximal to the slider, and a withdrawn position, wherein the thruster is distal from the slider, and a mechanical actuator associated with the handgrip and configured to actuate the thruster at least from the withdrawn position to the advanced position.

18 Claims, 9 Drawing Sheets

(56) References Cited

U.S. PATENT DOCUMENTS

| | | | | |
|---|---|---|---|---|
| 2021/0108425 | A1* | 4/2021 | Li | E04F 21/0092 |
| 2021/0238869 | A1* | 8/2021 | Li | B25B 7/22 |
| 2022/0112730 | A1* | 4/2022 | Sighinolfi | E04F 21/22 |
| 2023/0304308 | A1* | 9/2023 | Li | B25B 27/02 |

FOREIGN PATENT DOCUMENTS

| | | | | | |
|---|---|---|---|---|---|
| CN | 110344569 | A | * 10/2019 | | B25B 7/04 |
| CN | 213806442 | U | * 7/2021 | | |
| EP | 3556964 | A1 | * 10/2019 | | B25B 27/02 |
| EP | 3623106 | A1 | * 3/2020 | | B25B 7/04 |
| WO | WO-2018143829 | A1 | * 8/2018 | | E04F 21/22 |

* cited by examiner

TOOL FOR THE APPLICATION OF PRESSING WEDGES

TECHNICAL FIELD

The present invention relates to a tool for the application of pressing wedges in wedge-type levelling spacer systems used in the installation of tiles or slabs or the like (for example, ceramic slabs or tiles, or natural stone slabs or other slabs intended to define a floor or surface covering).

More particularly, the present invention relates to a manual tool for the application of pressing wedges in wedge-type levelling spacer systems formed by one or more (spacer and/or levelling) base blocks and one or more pressing wedges.

PRIOR ART

As is well known, in the tile (or ceramic slab) installation sector for floor or wall coverings, the use of levelling systems has developed, among which the wedge-type levelling spacer systems are well-known. Such wedge-type levelling spacer systems generally comprise:

- a base block formed by the union of a base, configured to be placed behind the application surface of at least two tiles placed side by side, and a bridge, rising squarely from the base and in which a window is at least partially defined which is intended to project above the application surface of the tiles placed side by side; and
- a pressing wedge, which is adapted to be wedged in the window between a crosspiece of the spacer bridge and the visible surface of the tiles resting on the base, so as to press the visible surfaces of the tiles towards the base, levelling them.

Also known are gripper-like hand tools that facilitate the installer in the operations of application of the pressing wedge, that is in the (final) steps of inserting the pressing wedge into the window to level the tiles.

Such gripper-like hand tools consist of two hinged levers of the first kind crossed over each other and operable manually in such a way that a manual compression of two handgrip ends corresponds to a contraction of the two opposite ends, in which an abutment slider for the bridge and an abutment thruster for the pressing wedge are defined respectively.

Since each installer is required to apply a large number of pressing wedges for the construction of a flooring (the greater the surface to be coated, the greater the number of pressing wedges to apply), a need felt in the sector is to facilitate as much as possible the task of the installers by relieving both the physical effort and the convenience of using these tools.

For example, it has been found that the use of known tools may not always be easy, e.g. on steps, where the user's hand struggles to find space to grasp both handgrip ends of the tool.

One need, therefore, is to make it increasingly convenient and possible to use the tool in comfort and safety, even in conditions of reduced installation space.

Furthermore, a need felt in the sector is to make the thrust of the pressing wedge as standardised as possible, thus reducing the possibility of error for the installer.

An object of the present invention is to meet the aforesaid requirements and others of the prior art, with a simple, rational and low-cost solution.

These objects are achieved by the features of the invention set forth in the independent claim. The dependent claims outline preferred and/or particularly advantageous aspects of the invention.

DISCLOSURE OF THE INVENTION

The invention, in particular, makes available a tool for the application of pressing wedges in wedge-type levelling spacer systems used in the application of tiles and which are provided with a base block and a pressing wedge, wherein the tool comprises:

- a handgrip from a front end of which projects a support rod having a longitudinal axis;
- a slider constrained to the support rod and at least partially delimiting a through opening configured to slidably receive at least one axial segment of the pressing wedge;
- a thruster associated with the handgrip in a movable manner at least along a thrusting direction parallel to the longitudinal axis of the support rod between an advanced position, wherein the thruster is proximal to the slider, and a withdrawn position, wherein the thruster is distal from the slider; and
- a mechanical (for example linear) actuator associated with the handgrip and configured to actuate the thruster at least from the withdrawn position to the advanced position.

A mechanical actuator is defined as a device designed to remotely control or move a secondary mechanism via an external power source, which may include a source of electrical current and a source of fluid (e.g. a liquid, such as oil, or a gas) under pressure.

Thanks to this solution it is possible to achieve the above-mentioned aims, in particular it is made possible to facilitate the operations of use and application of these tools for the application of pressing wedges, improving the execution of the work and facilitating the manual operations of the user and the physical effort required of him.

Advantageously, the mechanical actuator may comprise a fixed body rigidly fixed inside the handgrip and a moveable body projecting rigidly fixed to the thruster and configured to at least partially protrude from the handgrip.

Furthermore, the tool may comprise a control device associated externally with the handgrip, wherein the control device is configured to activate, upon manual command, the mechanical actuator.

Furthermore, the tool may comprise a selector device located inside the handgrip and slaved (i.e. connected, preferably electrically and/or pneumatically and/or hydraulically) to the mechanical actuator, wherein the selector device can be moved between an open configuration and a closed configuration by means of the control device.

According to a first embodiment, the mechanical actuator can be a pneumatic actuator.

In this first embodiment, the mechanical actuator may comprise a pneumatic connector configured to at least partially protrude from the handgrip and to be connected to a source of compressed air.

Furthermore, in this first embodiment, the source of compressed air may comprise or consists of an accumulation tank, wherein the compressed air in the accumulation tank has a maximum pressure greater than 10 bar.

Alternatively or additionally, the source of compressed air may comprise or consist of a compressor or a pump (e.g. an electric pump, preferably battery-operated), e.g. configured to generate and/or store compressed air at a pressure less than or equal to 10 bar or preferably greater than 10 bar.

For example, the compressor or the pump may be portable, e.g. carried by the user over the shoulder or by hand.

In a second embodiment of the invention, the mechanical actuator may be an electric actuator.

In such a case, the tool may comprise an electric power source (or battery) arranged at least partially inside the handgrip (e.g., fixed completely inside the handgrip or partially inside and partially outside the handgrip or fixed outside the hand-grip) and electrically connected to the mechanical actuator for the electrical powering thereof. For example, the battery can be removable and/or interchangeable or fixed, depending on needs.

As an alternative to the foregoing, the tool and/or the mechanical actuator may comprise an electrical connector configured to at least partially protrude from the handgrip and to be connected to a remote electrical power source.

Furthermore, according to one aspect of the invention, the thruster may be movable (exclusively) to slide along the thrusting direction parallel to the longitudinal axis of the support rod and the mechanical actuator is a linear actuator.

The invention, for the same purposes as above, also makes available a laying and levelling system of tiles that comprises:

- a levelling spacer system equipped with one or more base blocks and one or more pressing wedges each of which is configured to be slotted in a window of a base block along an insertion direction;
- a tool, as described above, wherein the through opening of the forked free end of the slider is configured to be arranged aligned, along the insertion direction, with the window by the base block on a first side thereof and the thruster is configured to be arranged on the opposite side of the slider with respect to the window of the base block behind the pressing wedge, with the thrusting direction substantially parallel to the insertion direction, so that the mechanical actuator, when it actuates the thruster from the withdrawn position to the advanced position, causes the thrusting of the pressing wedge by means of the thruster, along the insertion direction, inside the window of the base block.

BRIEF DESCRIPTION OF THE DRAWINGS

Further features and advantages of the invention will be more apparent after reading the following description provided by way of a non-limiting example, with the aid of the accompanying drawings.

BEST MODE TO IMPLEMENT THE INVENTION

Figure 1:
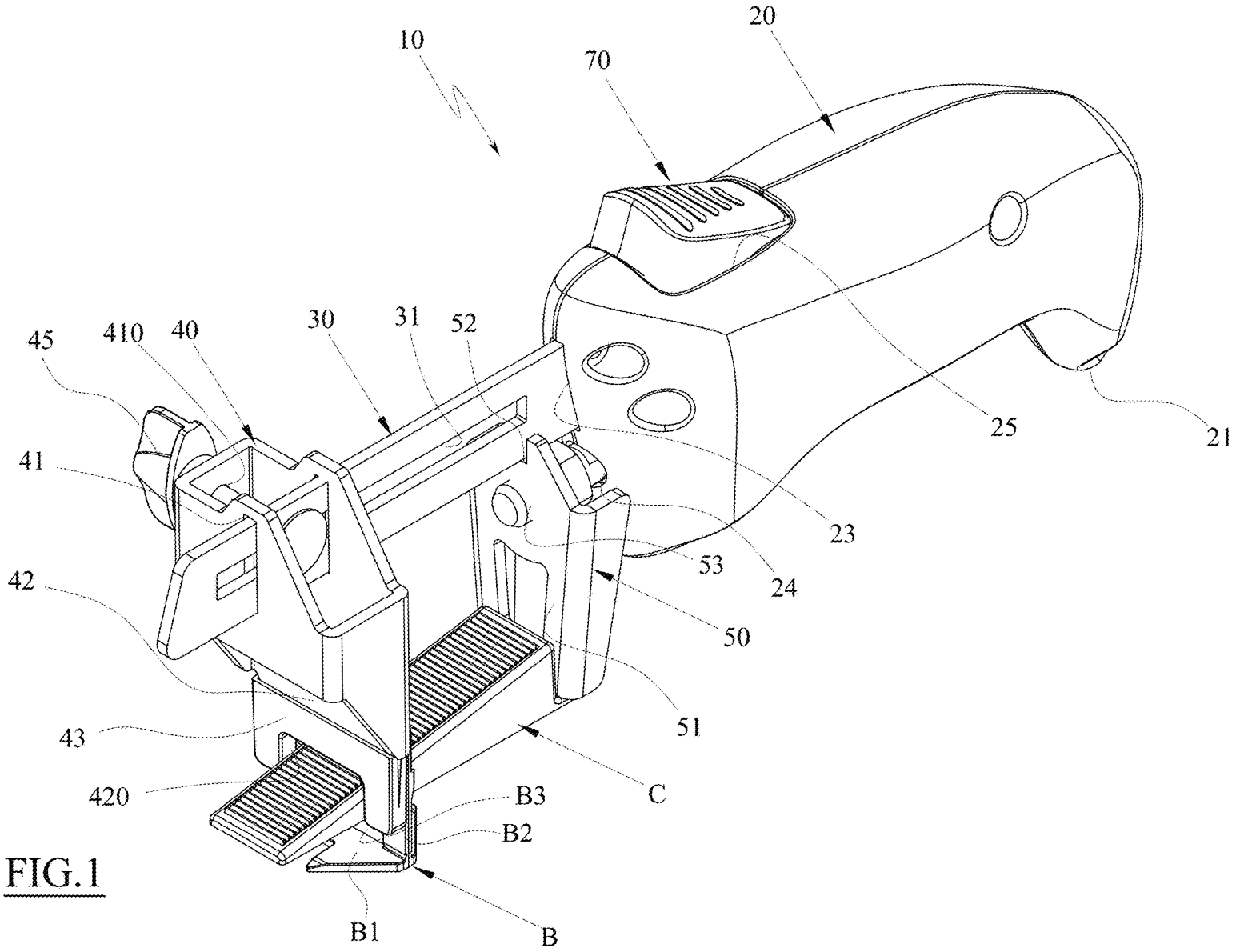
FIG. 1 is an axonometric view (from the left) of a tool according to the invention in use in a laying system.
Figure 2:
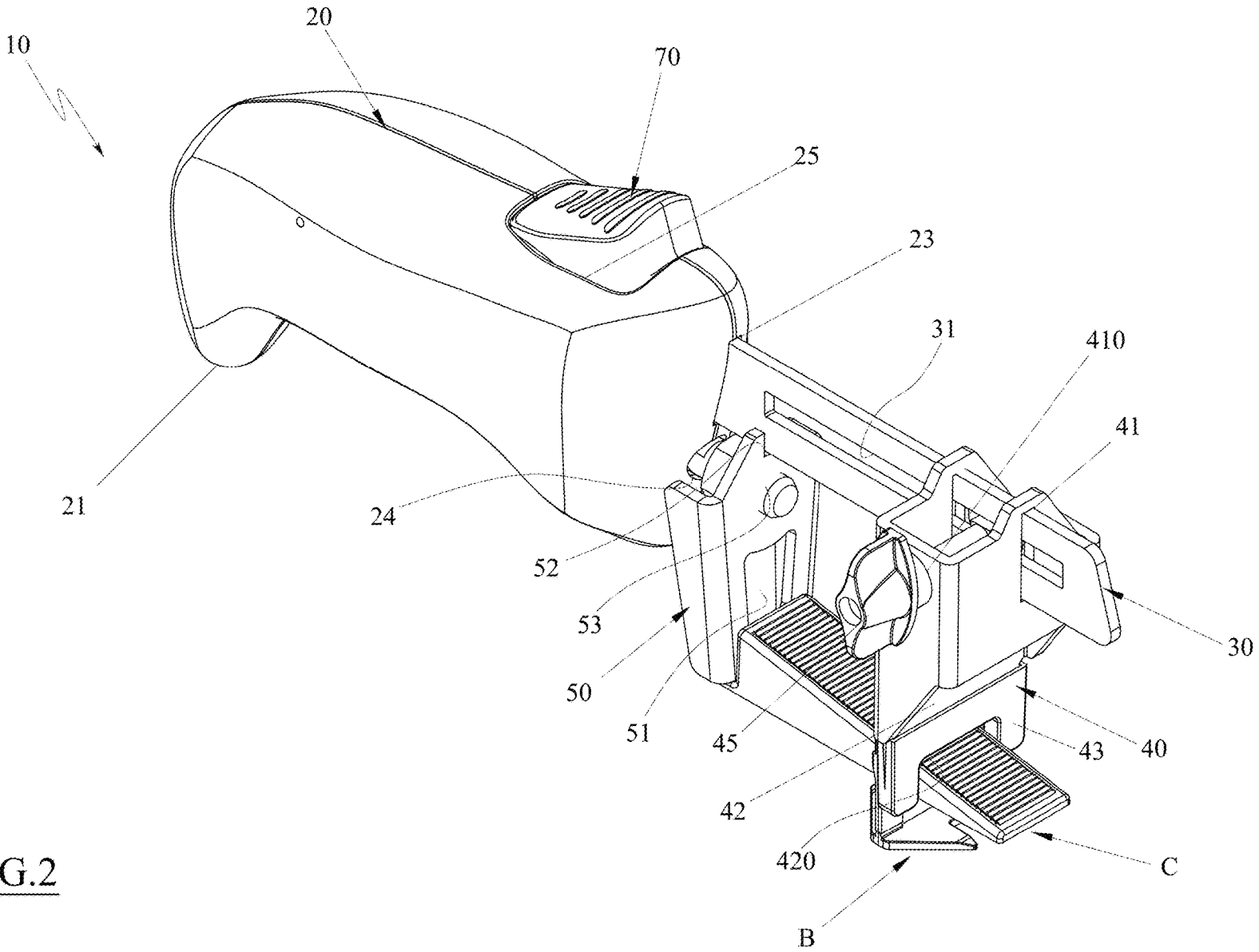
FIG. 2 is an axonometric view (from the right) of FIG. 1.
Figure 3:
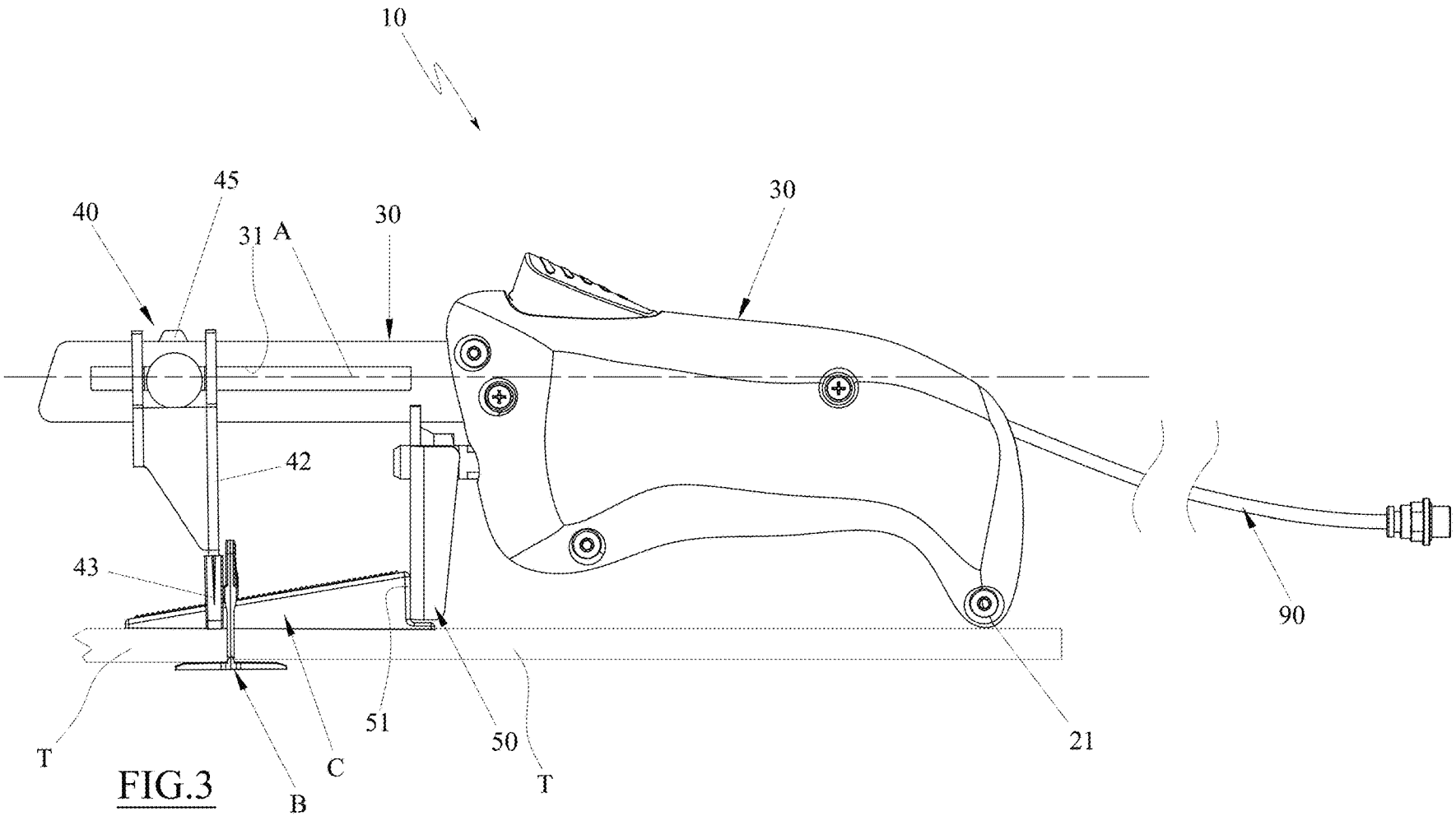
FIG. 3 is a left side view of FIG. 1.
Figure 4:
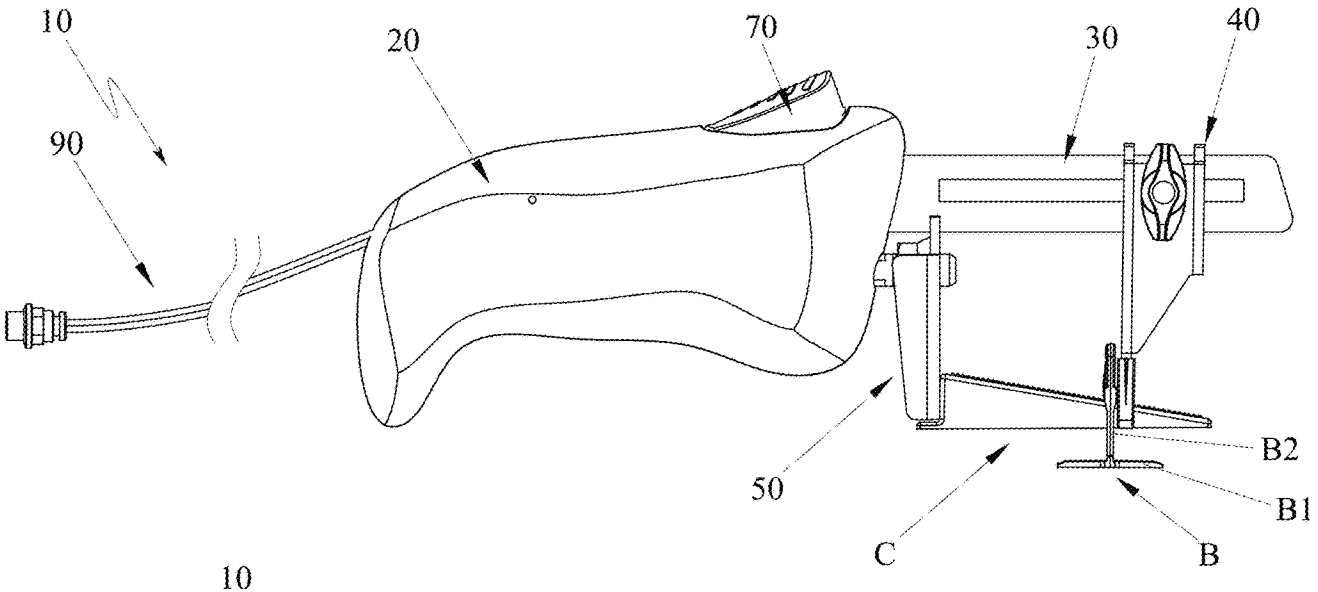
FIG. 4 is a right side view of FIG. 1.
Figure 5:
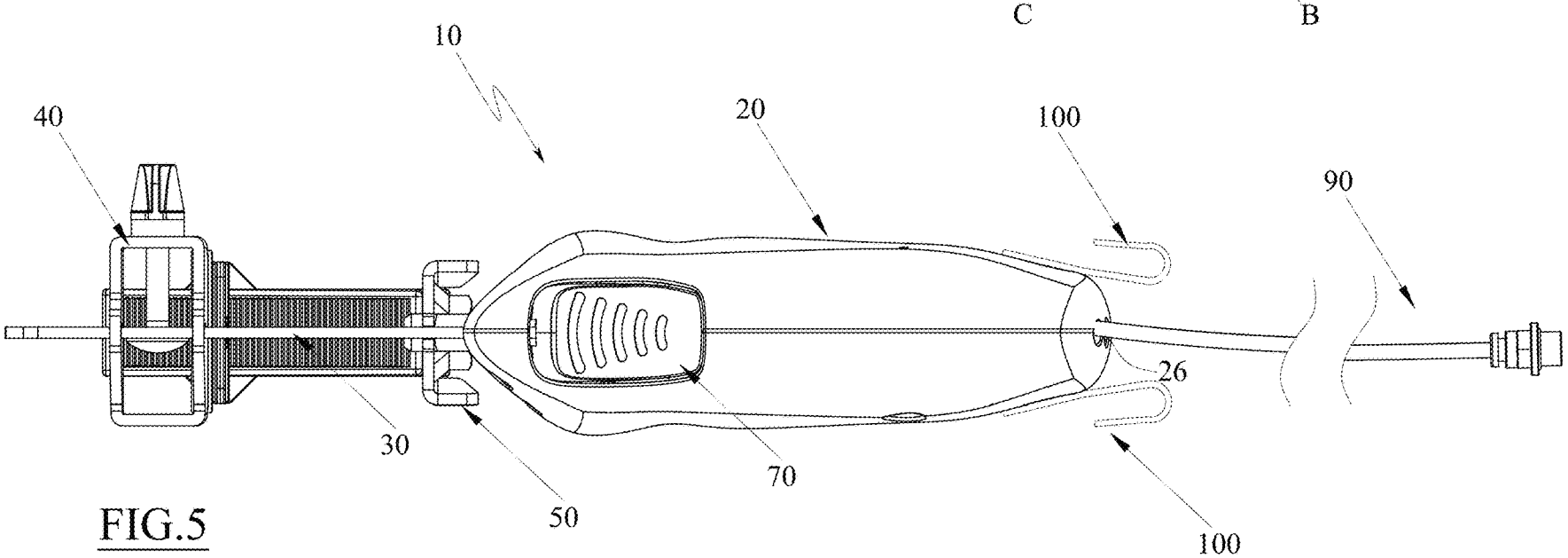
FIG. 5 is a plan view from above of FIG. 1.
Figure 6:
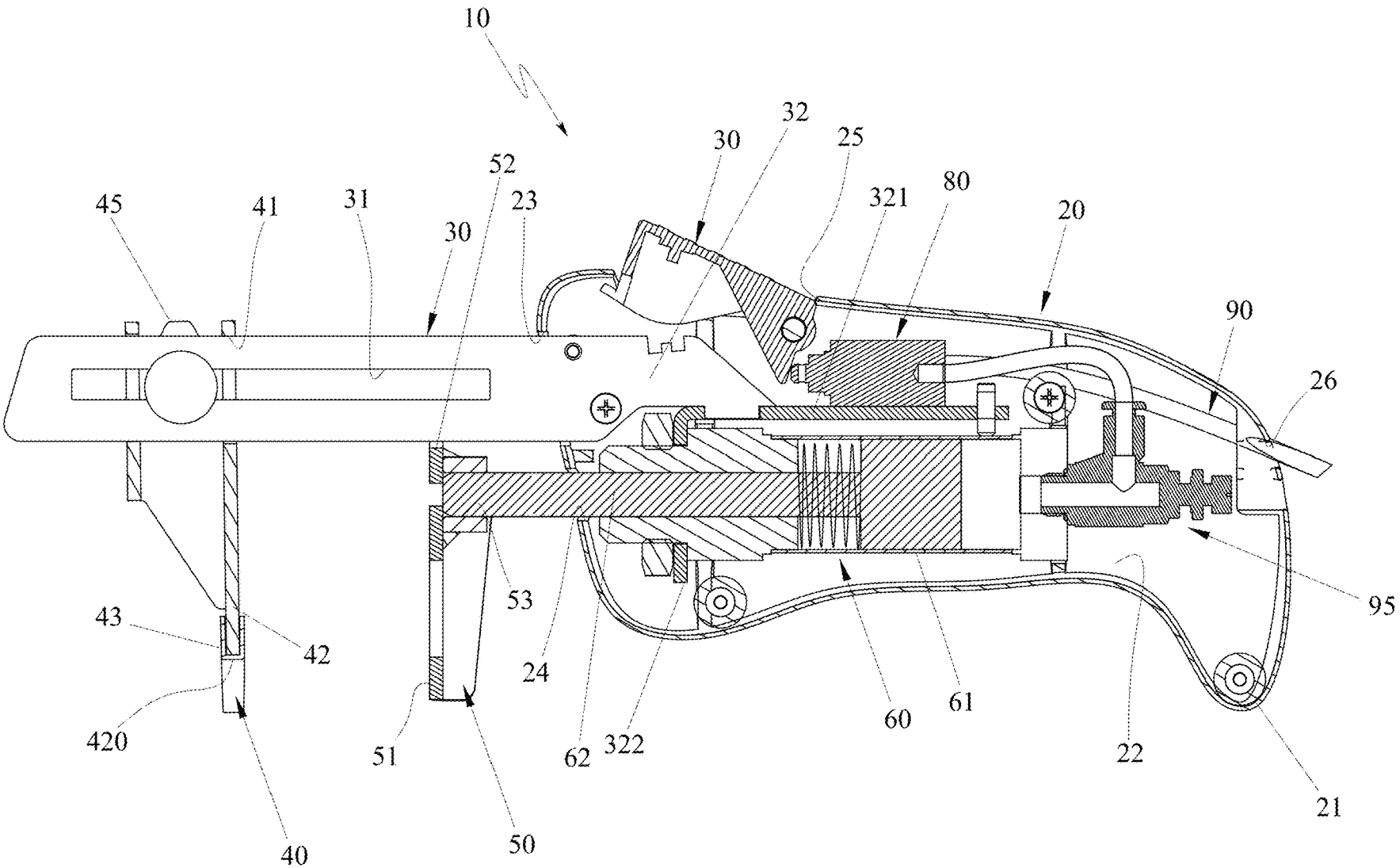
FIG. 6 is a sectional view along a longitudinal median plane (of the handgrip) of a tool according to a first embodiment of the invention, wherein the thruster is in an advanced position.

With particular reference to these figures, a tool for the application of pressing wedges in wedge-type levelling spacer systems used in the application of tiles has been globally referred to as 10.

The tool 10 is a hand tool, i.e., one that is suitable for being held by one hand (or both hands) of a user.

In this description, the term "lower" means, unless otherwise specified, an arrangement facing towards (or proximal to) the tiles being applied with the tool 10, whether they are applied on a horizontal or vertical or variously inclined application surface; similarly, the term "upper" means, unless otherwise specified, an arrangement facing the opposite side of (or distal from) the tiles being applied with the tool 10

The tool 10 comprises a (single) handgrip 20, which is configured to be grasped by one hand of a user.

The handgrip 20 comprises an elongated body (globally concave or rounded) extending along a longitudinal axis and having two opposing axial ends, one of which is a front end, for example facing anteriorly the index finger (and thumb) of the user's hand when grasped by him, for example, and an opposing rear end. The elongated body of the handgrip 20 comprises, for example, an enlarged front portion, ending with the front end, which defines an (ergonomic) abutment surface for the index finger (and possibly thumb) of the user's hand.

The elongated body also comprises an upper back, intended to contact the palm of the user's hand when the handgrip 20 is grasped, and an opposing lower belly. For example, the upper back is ergonomically curved, descending from the front end towards the rear end.

The lower belly defines, for example, a narrow zone, interposed between the opposite axial ends, which defines an indentation (substantially concave, with concavity facing outwards from the handgrip 20) for receiving the fingers (middle, ring and little fingers and possibly index finger) of the user's hand, when the handgrip 20 is grasped.

In addition, the elongated body comprises two opposing lateral flanks, e.g. which are symmetrical with respect to a longitudinal median plane of the handgrip 20 (which cuts the upper back and the lower belly).

The handgrip 20 further comprises a rest and/or abutment and/or reference appendage 21 (or foot), which is defined in proximity to or at the rear end thereof.

The appendage 21 extends inferiorly, e.g. radially, from the handgrip 20, i.e. inferiorly with respect to the lower belly.

For example, the appendage 21 defines the lower extremal part of the handgrip 20.

Preferably, the handgrip 20, i.e. its elongated body, is defined by the union, for example by means of tightening screws or other coupling and/or interlocking system, of two shells (symmetrical with respect to the longitudinal median plane of the handgrip).

The two shells are joined at a junction plane substantially coinciding with the longitudinal median plane of the handgrip 20.

For example, the handgrip 20, i.e., its elongated body, has an inner chamber 22 (defining an empty volume contained within the walls of the elongated body, i.e., by the two shells composing it).

Preferably, the handgrip 20 (i.e. the elongated body thereof, or—better—each of the shells that composes it) is made of a plastic material and, for example, is obtained by injection moulding.

Overall, the handgrip 20 is substantially rigid, i.e., non-deformable under the usual load conditions for which it is intended in use; however, it is not excluded that it may have soft or substantially soft gripping portions or coatings that increase the grip or comfort for the user's hand.

Preferably, a through hole 23 is made in the front end of the handgrip 20, with through axis substantially parallel to the longitudinal axis of the handgrip 20, preferably centred with respect to the median longitudinal plane.

The slot 23 essentially puts the inner chamber 22 of the handgrip 20 in communication with the outside of the handgrip 20.

The slot 23 may have an elongated (quadrangular) shape with longitudinal axis parallel to (and belonging to) the longitudinal median plane of the handgrip 20. Again, a through hole 24 may be made in the front end of the handgrip 20, for example circular, with through axis substantially parallel to the longitudinal axis of the handgrip 20, preferably centred with respect to the longitudinal median plane of the handgrip 20.

The hole 24, in essence, puts the inner chamber 22 of the handgrip 20 in communication with the outside of the handgrip 20.

Again, in the upper back of the handgrip 20, for example in proximity to the front end thereof, an upper opening 25 may be made, for example passing through, for example with through axis substantially parallel to the longitudinal median plane of the handgrip 20, preferably centred with respect to said longitudinal median plane. The upper opening 25, in essence, puts the inner chamber 22 of the handgrip 20 in communication with the outside of the handgrip 20.

The upper opening 25 may have an elongated (quadrangular) shape with longitudinal axis parallel to (and belonging to) the longitudinal median plane of the handgrip 20.

It is not excluded that the position of the upper opening 25 may be different from that illustrated and described, for example placed at the lower belly or at one or both side walls of the handgrip 20.

Again, a through slit 26 may be made in the rear end of the handgrip 20, for example circular, with through axis substantially parallel to the longitudinal axis of the handgrip 20, preferably centred with respect to the longitudinal median plane of the handgrip 20.

The slot 26, in essence, puts the inner chamber 22 of the handgrip 20 in communication with the outside of the handgrip 20.

The tool 10 then comprises a support rod 30, which has a longitudinal axis A (preferably straight and, for example, substantially coinciding with or parallel to the longitudinal axis of the handgrip 20).

The support rod 30 is rigidly fixed to the handgrip 20 so that it is extended axially.

More in detail, the support rod 30 protrudes anteriorly to the front end of the handgrip 20 (axially extending it).

For example, the support rod 30 is made in a separate body from the handgrip 20 and rigidly fixed thereto, as will be better described below.

Preferably, the support rod 30 comprises (or consists of) a front portion that projects externally and anteriorly from the handgrip 20, for example exiting from the slot 23 thereof, and a rear portion that is internally housed (concealed) within the handgrip.

Preferably, the support rod 30 is substantially rigid, i.e. it is not subject to appreciable deformations when subjected to the usual working loads to which it is intended in use.

For example, the support rod 30 is made of a metal material, e.g. steel.

It is not excluded, however, that the support rod 30 may be made as a single body with the handgrip 20 (and/or made of a plastic material, for example of the same material as the handgrip 20).

The length of the (front portion projecting from the handgrip 20 of the) support rod 30 is substantially equal to the length of the handgrip 20.

For example, the support rod 30 has a lateral thickness (for example, less than the lateral thickness of the handgrip 20) that is less than its height (which is, for example, less than the height of the handgrip 20) which, in turn, is less than its length.

The front portion projecting from the handgrip 20 of the support rod 30 preferably has a substantially constant cross section throughout its longitudinal development.

The support rod 30 (i.e. its front portion projecting from the handgrip 20) has a front end, distal from the handgrip 20, which is free and an opposing rear end which is constrained to the handgrip 20.

The front portion projecting from the handgrip 20 of the support rod 30 has, therefore, a front end coinciding with the front end of the support rod 30 and an opposing rear end (corresponding to a median zone of the support rod 20) flush with the front end of the handgrip 20.

For example, the support rod 30, i.e., its front portion, has an elongated slot 31 (along a longitudinal axis coinciding with the longitudinal axis A of the support rod 30), substantially with full development of the front portion, provided with two opposing closed longitudinal ends, of which a front end located in proximity to the front end of the support rod 30 and a rear end located in proximity to the front end of the handgrip 20 (i.e., the rear end of the front portion of the support rod 30).

The elongated slot 31 passes through the thickness of the support rod 30, i.e. in the direction orthogonal to the longitudinal median plane of the handgrip 20.

The support rod 30, i.e., its rear portion, comprises an anchoring root 32, which is configured to rigidly fix the support rod 30 to the handgrip 20.

Preferably, the anchoring root 32 arises posteriorly to the rear end of the front portion of the support rod 30, for example as a single body therewith, and constitutes the rear portion of the support rod 30.

The anchoring root 32 is arranged inside the handgrip 20, for example the inner chamber 22 thereof.

Preferably, the inner chamber 22 of the handgrip 20 defines a shape constraint for the anchoring root 32, for example such that it defines an interlocking constraint for the support rod 30.

The anchoring root 32 has a front end substantially coinciding with the rear end of the front portion of the support rod 30 and an opposing free rear end.

The anchoring root 32 has a fixing zone, for example proximal to its front end, which is configured to be rigidly fixed to the handgrip 20, for example by means of threaded members.

For example, in the fixing area there is provided a through hole within which a threaded member (or screw) is adapted to be accommodated for the (removable) fixing of the anchoring root 32 (and, therefore, of the support rod 30 as a whole) at a corresponding threaded hole formed inside the inner chamber 22 (at one of the shells) of the handgrip 20.

The anchoring root 32, for example, also has a first longitudinal bracket 321, for example presenting a longitudinal development substantially parallel to the longitudinal axis A of the support rod 30.

The first bracket 321 defines an upper rest plane, for example orthogonal to the longitudinal median plane of the handgrip 20 and parallel to the longitudinal axis A of the handgrip 20.

For example, the first bracket 321 is adapted to be interlocked or housed in a corresponding seat (or recess) made inside the inner chamber 22 (at one or both shells) of the handgrip 20.

The first bracket 321 develops, for example, from the opposite side of the front portion of the support rod 30 with respect to the fixing zone and, preferably, defines the rear end of the anchoring root 32 (and of the support rod 30 as a whole).

Preferably, the anchoring root 32, i.e., the first bracket 321, has a threaded through hole with through axis orthogonal to the longitudinal axis A of the handgrip 20 (and the upper rest plane), for example arranged in proximity to the rear end of the anchoring root 32.

The anchoring root 32, for example, also has a second transverse bracket 322, for example presenting a longitudinal development substantially orthogonal to the longitudinal axis A of the support rod 30.

For example, the second bracket 322 develops below with respect to the first bracket 321.

The second bracket 322 defines a rear abutment plane, for example orthogonal to the longitudinal median plane of the handgrip 20 and orthogonal to the longitudinal axis A of the handgrip 20.

For example, the second bracket 322 is adapted to be interlocked or housed in a corresponding seat (or recess) made inside the inner chamber 22 (at one or both shells) of the handgrip 20.

The second bracket 322 is proximal to the front end of the handgrip 20, for example at a non-zero distance therefrom.

The second shelf 322 develops, for example, in front of the first bracket 321 (and squared therewith).

Preferably, the anchoring root 32, i.e. the second bracket 322, has a through hole, for example circular, with through axis parallel to the longitudinal axis A of the handgrip 20.

The tool 10 further comprises a slider 40 constrained to the support rod 30, i.e., its front portion projecting anteriorly from the handgrip 20.

The slider 40 is configured to be freely positioned in any axial position of the support rod 30 and fixed therein, in a releasable manner.

The slider 40 comprises a rigid body (i.e. non-deformable under the working loads to which it is subjected during its normal use) which extends below the support rod 30.

More in detail, the slider 40, or the rigid body thereof, comprises an upper anchoring portion configured to anchor to the support rod 30 and a lower working portion extending below the support rod 30, for example in a direction orthogonal to the longitudinal axis A of the support rod.

The slider 40, for example, is configured to define a prismatic connection with the support rod 30, as will be better described below.

For example, the slider 40, i.e., its anchoring portion, comprises a substantially prismatic housing seat 41, passing from side to side of the slider (i.e., having two opposing open axial ends), wherein the longitudinal axis of the housing seat 41 is, in use, parallel to (and coincident with) the longitudinal axis A of the support rod 30.

For example, the housing seat 41 has a (constant) cross section substantially complementary to (and slightly larger than) the cross section of the support rod 30.

The housing seat 41 is configured to be fitted, with reduced radial clearance, on the support rod 30, so that the slider 40 can slide axially along the support rod 30.

Preferably, the anchoring portion has a substantially box-like shape, i.e. defined by a plurality of perimeter walls delimiting an empty central zone.

However, it is not excluded that the anchoring portion may have the shape substantially of a solid block or other according to the needs.

In the example, the anchoring portion comprises a front wall and a parallel rear wall (at a non-zero distance from the front wall) and at least one side wall, in the example two in number.

Each side wall is joined to the front wall and to the rear wall substantially squared with them.

For example, the housing seat 41 is defined by a pair of coaxially aligned (equal) through slots made in the front wall and the rear wall, respectively.

The side walls of the anchoring portion of the slider 40 flank, preferably at a non-zero distance, the side walls of the support rod 30 (when the slider 40 is fitted on the support rod 30).

In one of the side walls of the anchoring portion of the slider 40, a passage opening 410 is made, which has a through axis orthogonal to the longitudinal axis A of the support rod 30 (and orthogonal to the longitudinal median plane of the handgrip 20).

The slider 40, i.e. its working portion, comprises an abutment plate 42, which derives inferiorly from of the anchoring portion and has an upper end constrained to the anchoring portion, for example made as a single piece therewith, and a free lower end.

The abutment plate 42, for example, arises at the bottom from one of the front wall and the rear wall of the anchoring portion, in the example from the rear wall thereof.

For example, the abutment plate 42 has a front main face and an opposing rear main face, which faces the (front end of) handgrip 20.

Preferably, the slider 40, i.e. its working portion, comprises a through opening 420, which passes through the slider from side to side, wherein the through axis of the through opening 420 is, in use, parallel to (and coincident with) the longitudinal axis A of the support rod 30.

For example, the through opening 420 is defined at the free lower end (of the working portion) of the slider 40.

The through opening 420, for example, is open perimetrically at least inferiorly, i.e. at the free lower end (of the working portion) of the slider 40.

In particular, the abutment plate 42 has two facing lower legs that laterally delimit the through opening 420 (on opposite sides thereof) and that are joined (at their top) by an upper edge delimiting the through opening 420 thereof on the top.

The through opening 420 is substantially quadrangular, i.e. the upper edge is substantially squared with the inner sides of the lower legs.

The free lower end of slider 40 is defined by the lower ends of the lower legs.

In other words, the abutment plate 42 has a substantially forked shape at its free lower end, wherein the bifurcation delimits (laterally and superiorly) the through opening 420.

For example, the slider 40 (and/or the abutment plate 42) may be made of a metal material, for example steel.

In such a case, it may be provided that the slider 40 comprises a covering cap 43 covering at least the lower end (of the abutment plate 42) of the slider 40.

For example, the covering cap 43 preferably covers (inferiorly) the free ends of the lower legs.

In the example, the covering cap 43 (totally) covers the lower legs and at least a portion of the abutment plate 42 that comprises the upper edge delimiting the through opening 420.

For example, the covering cap 43 is made of a material having a lower hardness than the hardness of the slider 40, i.e. the abutment plate 42.

For example, the covering cap 43 is made of a plastic material.

It is not excluded, however, that the slider 40 (and/or the abutment plate 42) may be made of a plastic material.

The slider 40 is provided with a locking member 45 configured to temporarily and releasably lock the slider 40 in any axial position along the support rod 30.

The locking member 45, for example, is configured to be selectively tightened, for example manually, to lock the slider 40 in a certain axial position along the longitudinal axis A of the support rod 30 and to be released and allow the slider 40 to slide axially along the longitudinal axis A of the support rod 30.

The locking member 45, for example, is a threaded member, comprising a threaded stem slotted (with its longitudinal axis orthogonal to the longitudinal median plane of the handgrip 20) inside the elongated slot 31 of the support rod 30, with radial clearance, and an enlarged (flat) abutment head, defined at one end of the threaded stem, suitable for resting (and/or sliding) on a side wall of the support rod surrounding the elongated slot 31.

For example, the locking member 45 is slotted axially within the passage opening 410 of the anchoring portion of the slider 40 (aligned with an axial portion of the elongated slot 31 of the support rod 30).

The locking member also comprises a knob or a tightening lever adapted to be screwed onto the free end of the threaded rod, for the (manual) tightening and release of the slider 40.

The tool 10 further comprises a thruster 50 which is associated with the handgrip 20 in a movable manner, as will be better described below.

The thruster 50 is configured to exert a direct thrust towards the slider 40 (for the application of a pressing wedge).

The thruster 50 comprises a rigid body (i.e., non-deformable under the working loads to which it is subjected during its normal use) that is arranged below the support rod 30, for example substantially facing the rear of the slider 40 (at a non-zero distance from it).

The thruster 50, i.e., its rigid body, comprises a front contact face 51, which faces (the main rear face of the abutment plate 42 of) the slider 40, and an opposing rear face.

The front face 51 is substantially planar (or planar in segments), so as to define a rest plane substantially parallel to the (rear main face of the) abutment plate 42, i.e. orthogonal to the longitudinal axis A of the handgrip 20.

For example, the thruster 50 comprises an upper portion, proximal to the support rod 30 and a lower working portion, defining the aforesaid front face 51, which extends inferiorly to the support rod 30, for example in a direction orthogonal to the longitudinal axis A of the support rod.

Preferably (but not limitedly), the thruster 50 is movable (with respect to the support rod 30 and/or the handgrip 20) at least along a thrusting direction parallel to the longitudinal axis A of the support rod 30, alternatively between an advanced position, wherein the thruster 50 is proximal to the slider 40, for example at a first (non-zero) distance therefrom, and a withdrawn position, wherein the thruster 50 is distal from the slider 40, for example at a second distance therefrom, wherein the second distance is greater than the aforesaid first distance.

Preferably, the thruster 50 is movable to translate, i.e. it is sliding, with respect to the support rod 30 and/or to the handgrip 20.

In this case, the thrusting direction is straight and (always) parallel to the longitudinal axis A.

For example, the thruster 50, i.e., its upper portion, comprises guiding means suitable for cooperating with the support rod 30 to guide the sliding of the thruster 50 along the thrusting direction.

For example, the guiding means comprise a guiding groove 52 made at the top of the upper portion adapted to laterally and/or inferiorly embrace a (lower) portion of the support rod, so as to define a substantially prismatic (with clearance), anti-rotational connection therewith.

For example, the thruster 50 has a substantially forked shape, wherein the upper portion is joined and the lower portion is separated.

Preferably, the thruster, i.e. its rigid body, comprises an attachment hole 53, for example made in a central zone of the thruster between the upper portion and the lower portion.

The attachment hole 53 has a (through) axis parallel to the thrusting direction.

For example, the lower free end of the thruster 50 (distal from the support rod 30) is substantially coplanar to the lower free end of the appendage 21.

The lower free end of the slider 40 (distal from the support rod 30) is, in turn, substantially coplanar (or slightly arranged superiorly) to the lower free end of the thruster 50 and/or to the lower free end of the appendage 21.

The tool 10 comprises, in particular, a mechanical actuator 60, which is configured to actuate the movement of the thruster 50 at least from the withdrawn position to the advanced position, preferably alternatively between the withdrawn position and the advanced position (i.e. in both movement directions).

The mechanical actuator 60 is associated with the handgrip 20, as will be better described below.

In particular, the mechanical actuator 60 is supported (or placed on board) the handgrip 20.

For example, the mechanical actuator 60 is at least partially located within the (inner chamber 22 of the) handgrip 20.

Preferably, but not limitedly, the mechanical actuator 60 is of the linear type (i.e. it is a linear actuator).

The mechanical actuator 60 comprises, for example, a fixed body 61 rigidly fixed to the handgrip 20, for example within the (inner chamber 22 of) same.

The fixed body 61 is for example arranged in a special compartment of the (inner chamber 22 of the) handgrip 20, e.g. arranged inferiorly to the first bracket 321 (and posteriorly to the second bracket 322).

For example, the fixed body 61 has a front end slotted and locked (by locking means, for example threaded) into the through hole of the (second bracket 322 of the) anchoring root 32.

Further, the locking means may comprise a tightening grub screw, which is adapted to be screwed into the threaded through hole of the (first bracket 321 of the) anchoring root 32, so as to clamped on (the outer jacket of) the fixed body 61.

Further, the mechanical actuator 60 comprises a movable body 62, which is movably, e.g. slidingly, associated with the fixed body 61, e.g. within it, between a retracted configuration and an extracted configuration.

Between the retracted configuration and the extracted configuration, the mechanical actuator 60, i.e. the movable body 62 thereof, completes a stroke of a predetermined and, for example, fixed length, preferably comprised between 1 and 3 cm, preferably 2 cm.

In other words, the mechanical actuator 60 is configured to be switched between a contracted configuration, in which the movable body 62 is in the retracted configuration within the fixed body 61, and an extended configuration, in which the movable body 62 is in the extracted configuration from the fixed body 61.

For example, the movable body 62 is configured as a stem and has a rear end (always) located inside the fixed body 61 and an opposing front end (always) located outside the fixed body 61.

For example, the movable body 62 is slidingly associated with the fixed body 61 with respect to a sliding direction parallel to (and coinciding with) the thrusting direction (and parallel to the longitudinal axis A of the support rod 30).

The movable body 62 of the mechanical actuator 60 is configured to at least partially protrude from the (inner cavity 22 of the) handgrip 20.

Advantageously, the movable body 62 is slotted (with clearance) axially into the hole 24 of the handgrip 20.

The movable body 62, i.e. its projecting position outside the handgrip 20, is rigidly fixed to the thruster 50, i.e. it rigidly supports the thruster 50.

Preferably, the thruster 50 is rigidly fixed to the front end of the movable body 62.

In the example, the front end of the movable body 62 is inserted axially into the attachment hole 53 of the thruster 50 and locked therein by means of a tightening connection, for example threaded.

In practice, when the mechanical actuator 60 is in its contracted configuration (in which the movable body 62 is in its retracted configuration), the thruster 50 is in its withdrawn position, when—on the other hand—the mechanical actuator 60 is in its extended configuration (in which the movable body 62 is in its extracted configuration), the thruster 50 is in its advanced position.

The mechanical actuator 60 is an actuator with automatic or assisted actuation (not manual).

Preferably, the tool 10, i.e., the mechanical actuator 60, comprises a control circuit of the mechanical actuator 60.

The control circuit (and/or the tool 10 in general), for example, comprises a control device 70 configured to activate, upon manual command, the mechanical actuator 60.

The control device 70, in particular, is configured to selectively control the switching of the mechanical actuator 60 between its contracted configuration and its extended configuration.

The control device 70, for example, is at least partially associated with the outside of the handgrip 20 (or at least so as to be contacted—by at least one finger of the user—from the outside of the handgrip 20).

For example, the control device 70 is arranged above the handgrip 20, preferably at the upper opening 25 (so as to occlude it).

In particular, the control device 70 is associated with the handgrip 20 in a movable manner, at least between two positions (stable or at least one of which is stable), of which an activation position and a deactivation position (and a neutral position).

For example, the control device 70 is hinged (like a lever) and/or is slidingly associated (like a button) with the handgrip 20.

By (manually) switching the control device 70 from the deactivation position (or from the neutral position) to the activation position, the control device 70 is configured to control or activate the mechanical actuator 60 so that it switches from the contracted configuration to the extended configuration (and, therefore, the thruster 50 from the distanced position to the approached position); on the other hand, by switching (manually) the control device 70 from the activation position (or from the neutral position) to the deactivation position, the control device 70 is configured to control or deactivate the mechanical actuator 60 so that it passes from the extended configuration to the contracted configuration (and, therefore, the thruster 50 from the approached position to the distanced position).

Again, the control circuit (and/or the tool 10 in general) comprises a selector device 80 slaved to the mechanical actuator 60 and configured to selectively move the mechanical actuator 60 from the contracted configuration to the extended configuration and from the extended configuration to the contracted configuration.

For example, the selector device 80 is connected, as will be better described below, to the mechanical actuator 60 and can be selectively moved between an open configuration, in which it is configured to move the mechanical actuator 60 from the contracted configuration to the extended configuration, and a closed configuration, in which it is configured to move the mechanical actuator 60 from the extended configuration to the contracted configuration (or deactivate the mechanical actuator 60 so that it returns, in a forced manner, to its retracted configuration).

The selector device 80 is also connected to the control device 70.

In practice, the control device 70 is configured to switch the selector device 80 between the open configuration and the closed configuration thereof.

In detail, when the control device 70 is brought (manually) into the activation position, the same switches the selector device 80 into its open configuration and when the control device 70 is brought (manually) into the deactivation (or neutral) position, the same switches the selector device 80 into its closed configuration.

Preferably, the selector device 80 is arranged within the (inner chamber 22 of the) handgrip 20, for example in a special compartment thereof, preferably above the upper rest plane defined by the first bracket 321 of the anchoring root.

For example, the selector device 80 is rigidly fixed to the handgrip 20, preferably it is rigidly fixed, for example by means of a threaded connection, above the upper rest plane defined by the first bracket 321 of the anchoring root 32.

The control circuit (and/or the tool 10 in general) comprises, then, a supply line 90 operatively connected to the selector device 80 for supplying the mechanical actuator 60 with an energy source 91 that supplies energy to the mechanical actuator 60, which converts it into mechanical work.

The supply line 90 may be associated with and supported by the handgrip 20 of the tool 10 (e.g., internally or partially internally to the inner chamber 22 of the handgrip 20).

The energy source 91 may be associated with and supported by the handgrip 20 of the tool 10 (e.g., internally or partially internally to the inner chamber 22 of the handgrip 20 or externally to the handgrip 20) or be detached from the handgrip 20 and from the tool 10 and arranged remotely from the tool 10.

Again, the control circuit (and/or the tool 10 in general) may comprise an adjustment assembly 95, which will be more fully described below, which is configured to adjust the movement speed and/or the thrust force of the thruster 30 at least in the advancement stroke from the withdrawn position to the advanced position.

The adjustment assembly 95 may be associated with and supported by the handgrip 20 of the tool 10 (for example internally or partially internally to the inner chamber 22 of the handgrip 20), so as to be accessible (for the manual activation thereof) from outside the handgrip 20.

Alternatively, the adjustment assembly 95 may be arranged in a position that is remote from the tool 10, for example associated with the energy source 91.

In a first embodiment shown in FIGS. 1-7 (and 7*a* and 7*b*), the mechanical actuator 60 is of the pneumatic type, i.e. it is a pneumatically actuated mechanical actuator.

In such a case, the energy source 91 supplying the mechanical actuator 60 comprises compressed air (wherein the air pressure defines the energy delivered by the energy source 91).

In such a first embodiment, the fixed body 61 of the mechanical actuator 60 delimits an inner (cylindrical) chamber, e.g. hermetically sealed, within which a piston rigidly fixed to (the rear end of) the movable body 62 is slidingly coupled (sealingly).

The piston divides the inner chamber into two variable-volume environments, one at the front and one at the rear.

The piston is movable alternately between a rear position, wherein the volume of the rear environment is minimum (and the volume of the front environment is maximum), and a front position, wherein the volume of the front environment is minimum (and the volume of the rear environment is maximum).

When the piston is in its rear position, the mechanical actuator 60 is in its contracted configuration, and when the piston is in its front position, the mechanical actuator 60 is in its extended configuration.

The fixed body 61 comprises an access mouth (for compressed air), which is for example radial or axial, in communication with the rear environment of the inner chamber.

A flow of compressed air entering the rear environment of the inner chamber is adapted to push the piston from the rear position to the front position, thereby switching the mechanical actuator 60 from the contracted configuration to the extended configuration.

In addition, there are provided return means within the front environment, e.g. elastic ones, such as a (helical) spring, configured to push the piston from the front position towards the rear position (opposed to the thrust action exerted by the air flow).

In essence, the return means are compressed by the piston when it is brought to its front position and are extended to bring the piston back to its rear position.

In practice, when the air flow is lost, the return means are adapted to push the piston from the front position to the rear position, thereby switching the mechanical actuator 60 from the extended to the contracted configuration.

In such an embodiment, the selector device 80 comprises (or consists of) a valve, for example a multi-way valve.

The valve, for example, has a valve body provided with an inlet, an outlet and a vent.

Inside the valve body there is a shutter device (slide-type), which can be selectively moved between a first operating position, in which it puts the inlet in fluid communication with the outlet (occluding the vent), and a second operating position, in which it puts the outlet in communication with the vent (occluding the inlet).

The valve inlet is connected to the supply line, as will be better described below.

The valve outlet is connected to the access mouth of the fixed body 61 of the mechanical actuator 60, for example, directly or by means of a connecting duct.

The valve vent is connected to the valve outlet, e.g. by means of ducting inside the valve.

The vent is configured to put the rear environment in fluid communication with the atmosphere.

When the shutter device of the valve is in its first operating position, the selector device 80 is in its open configuration described above, when—on the other hand—the shutter device of the valve is in its second operating position, the selector device 80 is in its closed configuration.

The position of the shutter device is selected (manually by the operator) by actuating the control device 70, as described above.

In such an embodiment, the supply line 90 comprises a duct, for example flexible and/or extendable (preferably but not limitedly spiralled), which comprises a first connection end and a second connection end.

The first connection end of the duct is configured to be connected (e.g. in an unremovable or removable manner) to the valve inlet.

The second connection end of the duct is configured to be connected (e.g. removably) to an outlet of the energy source 91.

Figure 7:
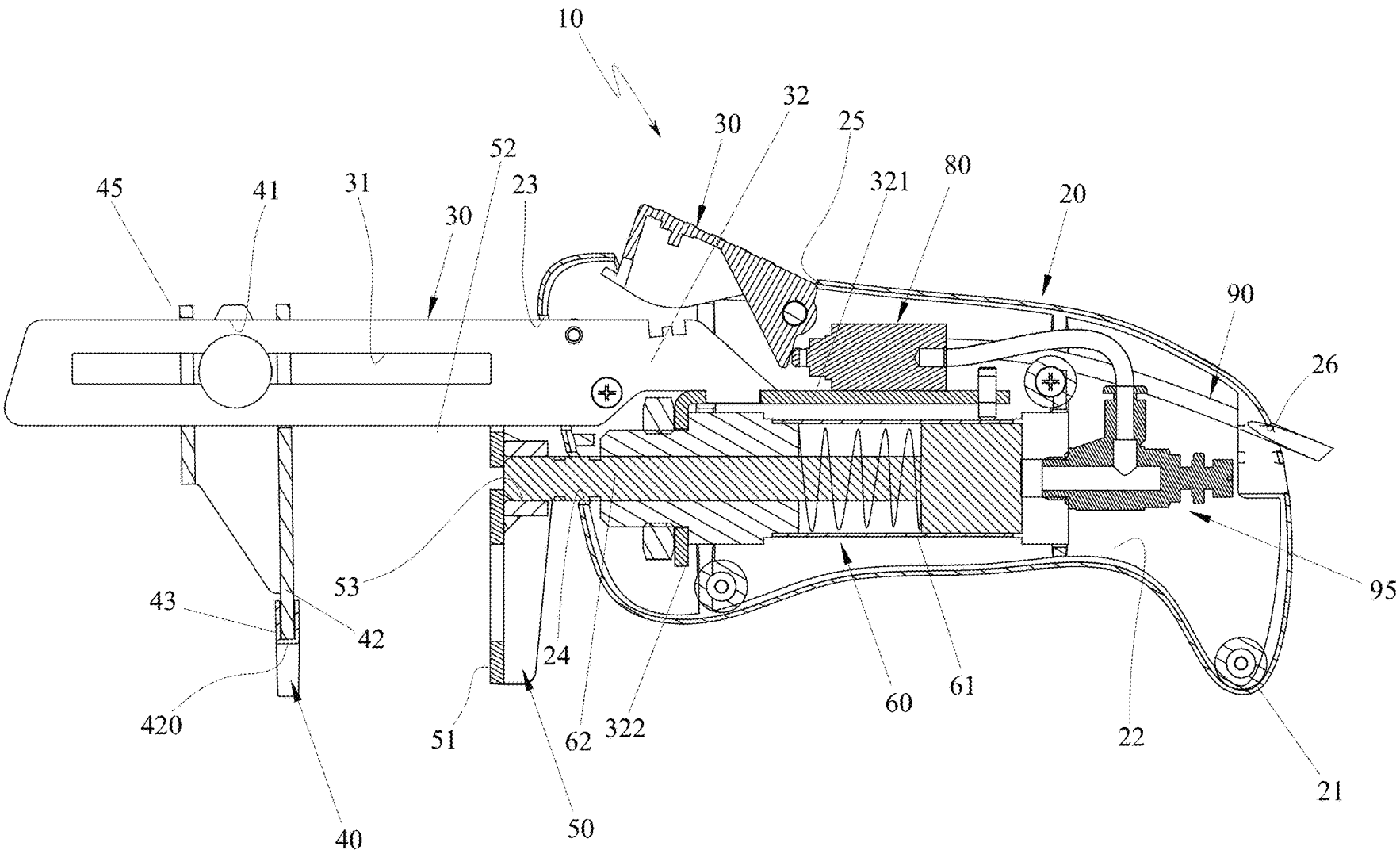
FIG. 7 is a sectional view along the aforesaid longitudinal median plane of FIG. 6, wherein the thruster is in a withdrawn position.
Figure 7A:
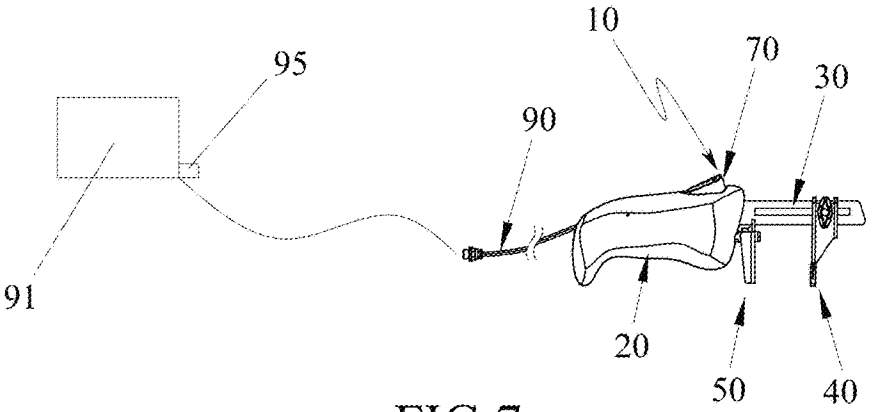
FIG. 7*a* is a schematic view of a first variant of the tool according to the first embodiment.

In a first variant of the first embodiment shown in FIG. 7*a*, the energy source 91 comprises an air compressor (e.g. of the portable and/or conventional type) or a pump (e.g. fixed or portable, e.g. an electric pump, preferably battery-operated).

The compressor and/or the pump is configured to generate and/or store a certain amount of compressed air to be made available to the supply line 91.

For example, the pump and/or the compressor is of the portable type, i.e. suitable for being carried by hand or over the shoulder by the user (while using the tool 10).

Figure 7B:
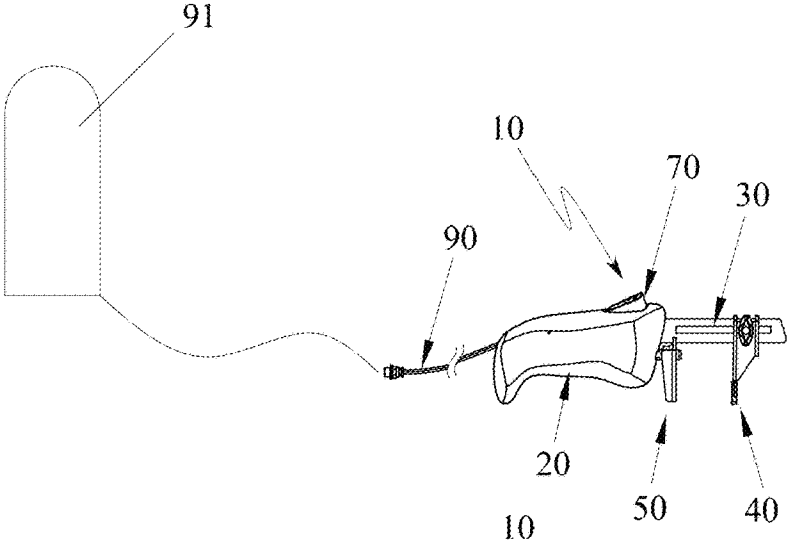
FIG. 7*b* is a schematic view of a second variant of the tool according to the first embodiment.

In a second variant of the first embodiment shown in FIG. 7*b*, the energy source 91 comprises (or consists of) an accumulation tank (preferably portable, i.e. provided with a handgrip and/or a hook for carrying it, e.g. by hand or over the shoulder).

A predetermined amount of (maximum) compressed air is contained within the accumulation tank, the maximum pressure of which is, for example, greater than 10 bar, preferably comprised between 100 bar and 400 bar, more preferably comprised between 200 bar and 300 bar.

The accumulation tank comprises an inlet for filling compressed air (e.g. by means of a suitable compressor) and an outlet that can be connected to the second connection end of the duct (defining the supply line 90).

It is possible to provide that the inlet and the outlet may coincide.

Furthermore, the adjustment assembly 95, in such an embodiment, comprises a flow regulator, which—for example—comprises a manual actuation grub screw that is arranged at the slit 26, so as to be actuated (manually or by means of an actuation tool, such as a screwdriver).

The flow regulator is located inside the handgrip 20 (and the only portion thereof that is accessible from the outside is said actuation grub screw).

The flow regulator is, for example, interposed between the valve outlet and the access mouth of the fixed body and is configured to vary (by means of a special calibrated throttling and/or venting device) the flow rate of compressed air entering the access mouth of the fixed body.

A change in the flow rate of compressed air generates a corresponding change in the movement speed (translation) of the thruster 50.

Alternatively or in addition, the adjustment assembly 95, in this embodiment, comprises a compressed air pressure regulator.

The pressure regulator (or pressure switch) is configured to vary the pressure of the compressed air.

For example, the pressure regulator is associated with the energy source 91, i.e. with the compressor or with the accumulation tank.

A change in the pressure of the compressed air generates a corresponding change in the thrust (translation) force acting on the thruster 50.

In a second embodiment shown in FIGS. (1-2 and) 8-10, the mechanical actuator 60 is an electrically driven mechanical actuator.

In such a case, the energy source 91 supplying the mechanical actuator 60 comprises an electrical energy source (wherein the electrical energy defines the energy supplied by the energy source 91).

In this second embodiment, the fixed body 61 comprises an electric motor and mechanisms for transforming a rotary motion (of the rotor) of the electric motor into a linear (alternating) motion of the movable body 62.

In such an embodiment, the selector device 80 comprises (or consists of) a switch, for example a three-position switch.

In particular, the switch features:

- a first operating position, in which it electrically powers the (electric motor of the) mechanical actuator 60 so that the movable body 62 is actuated in an advancement direction from the withdrawn position towards the advanced position,
- a second operating position, in which it electrically powers the (electric motor of the) mechanical actuator 60 so that the movable body 62 is actuated in an opposite withdrawn direction from the advanced position towards the withdrawn position, and
- a third operating position, in which it interrupts the electric power supply to the (electric motor of the) mechanical actuator 60 so that the movable body 62 stops its stroke in one of the withdrawn position, the advanced position or any position in between.

When the switch is in its first operating position and/or in its second operating position, the selector device 80 is in its open configuration described above, when—on the other hand—the switch is in its third operating position, the selector device 80 is in its closed configuration.

The position of the switch is selected (manually by the operator) by actuating the control device 70, as described above.

In such an embodiment, the supply line 90 comprises an electrical cable, which is for example flexible and/or extendable (preferably but not limitedly spiralled), which comprises a first connection end and a second connection end.

The first connection end of the duct is configured to be connected (e.g. in an unremovable or removable manner) to the switch.

The second connection end of the duct is configured to be connected (e.g. in an unremovable or removable manner) to the energy source 91.

Figure 10:
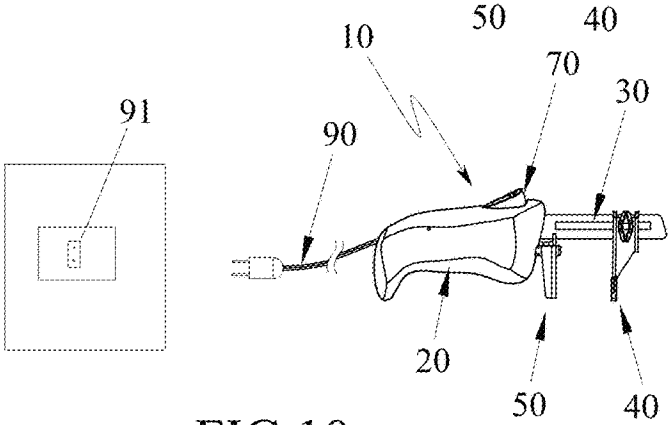
FIG. 10 is a schematic view of a first variant of the tool according to the second embodiment.

In a first variant of the second embodiment shown in FIG. 10, the energy source 91 comprises or consists of the (fixed) power mains.

In this case, the supply line 90 extends outward from the handgrip 20, with its second connection end configured as a plug for the connection to a complementary power mains socket.

Figure 8:
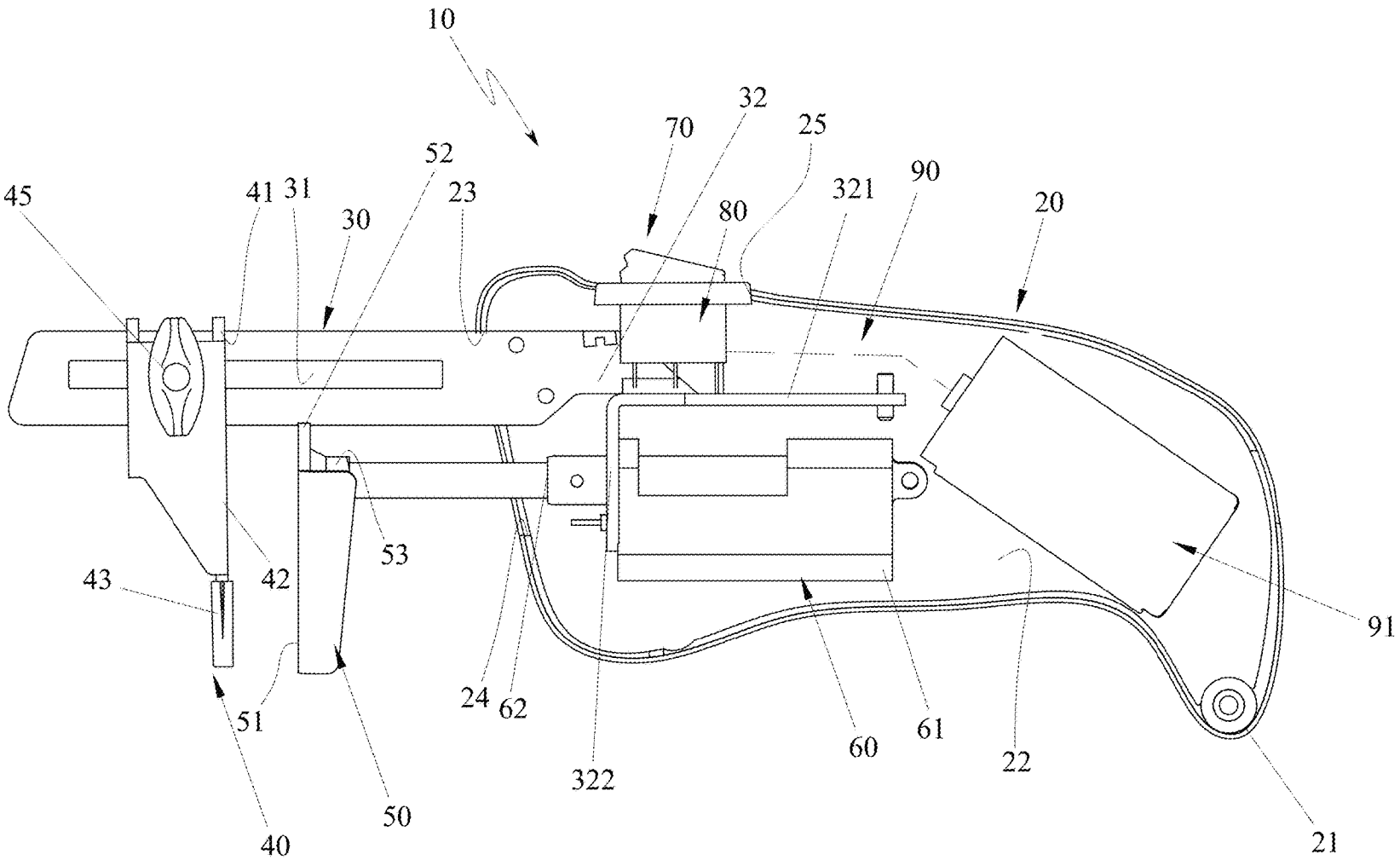
FIG. 8 is a sectional view along a longitudinal median plane (of the handgrip) of a tool according to a (second variant of a) second embodiment of the invention, wherein the thruster is in an advanced position.
Figure 9:
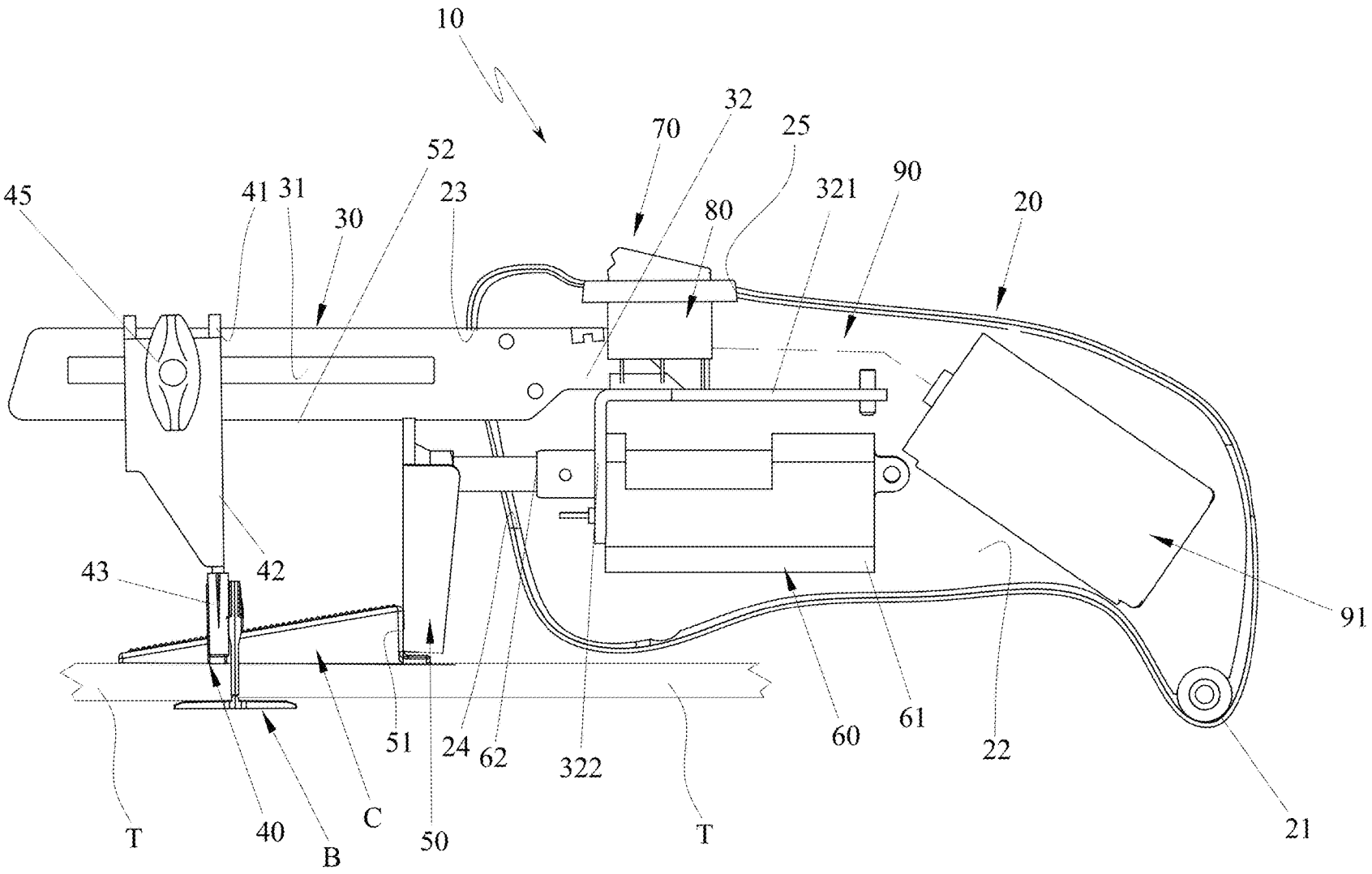
FIG. 9 is a sectional view along the aforesaid longitudinal median plane of FIG. 8, wherein the thruster is in a withdrawn position (and in use in a laying system).

In a second variant of the second embodiment shown in FIGS. 8 and 9, the energy source 91 comprises (or consists of) a (portable) battery.

The battery can be arranged externally to the handgrip 20, for example in a remote (fixed) position or carried by the user of the tool 10 (in which case it can be provided with a handgrip and/or a hook for carrying the same).

Preferably, as illustrated, the battery can be placed on board the handgrip 20, e.g. it can be arranged at least partially inside the handgrip 20, e.g. contained (totally or at least partially) in a special compartment (preferably behind the electric actuator 60) or, at the limit be fixed outside the handgrip.

A predetermined (maximum) amount of electrical energy charge is stored in the battery.

The battery comprises an electrical connector that can be connected to an electric power source for charging the battery and an electrical connector (which can also be the same as described above) that can be connected to the second end of the electrical cable (which defines the supply line 90).

Furthermore, the adjustment assembly 95, in such an embodiment, comprises a power regulator (dimmer or rheostat), which —for example—comprises a manual actuation grub screw that is arranged at the slit 26, so as to be actuated (manually or by means of an actuation tool, such as a screwdriver).

The power regulator is located inside the handgrip 20 (and the only portion thereof that is accessible from the outside is said actuating grub screw).

The power regulator is, for example, interposed between the battery and the mechanical actuator 60 and is configured to vary the power of the electrical energy supplying the mechanical actuator 60.

A change in power generates a corresponding change in the movement speed (translation) of the thruster 50 and/or in the (maximum) thrust force acting on the thruster 50.

The tool 10 (in all embodiments described above) may further comprise at least one fastener 100 configured to temporarily fix the tool 10 to a user's garment, for example to the belt (which wraps the hips) of the user.

For example, the fastener 100, which for example consists of or comprises a hook or clip, is fixed externally to the handgrip 20, for example behind it (i.e. at a rear portion thereof).

Preferably, the fastener 100 is placed on a flank of the handgrip 20.

Advantageously, the tool 10 may comprise a pair of fasteners 100 located on opposite sides of the handgrip 20 (for hooking to the right or left of the user).

The tool 10 described above, with reference to all the embodiments thereof, forms a component of a laying system, which also comprises a levelling spacer system, used in the application of tiles and the like, collectively indicated by the letter T (which may also be part of the application system).

The levelling spacer system, in particular, is of the type of a wedge-type levelling spacer system.

In detail, the levelling spacer system comprises a base block B equipped with a base B1 an upper surface defining a rest plane for at least two tiles T placed side by side along a flanking direction.

The base B1 is intended to be placed behind the application surface of the tiles T (opposed to the visible surface thereof).

The base block B comprises, then, a bridge B2 which rises from the base B1 substantially squared with said rest plane.

The bridge B2 is intended in use to be placed within the gap (or joint) between at least two flanked tiles T (so as to define their mutual distance).

In the bridge B2 or between the bridge B2 and the base B1, a window B3 (passing with through axis parallel to the aforesaid flanking direction) is defined, e.g. quadrangular, which is configured to project above the application surface of the flanked tiles T.

In practice, the bridge B2 has an edge that delimits window B3 at the top (placed at a non-zero distance from the visible surface of the tiles T).

The bridge B2 is generally formed as one piece (plastic material) with the base B1 and is adapted to be separated therefrom by fracturing along a predetermined fracture line defined by a weakening of the section.

The levelling spacer system comprises a plurality of base blocks B, as described above, for the application of a floor covering.

The levelling spacer system also comprises a pressing wedge C (e.g. separated or joined in some way to the respective base block B).

The pressing wedge C is a rectangular wedge, e.g. it is provided with a flat lower surface which can be arranged, in use, parallel to the rest plane defined by the upper surface of the base B1 of the base block B, and an upper surface inclined with respect to the lower surface and provided with, for example, abutment elements, such as teeth or knurls.

The pressing wedge C has variable (and steadily growing) thickness along its longitudinal axis from a tapered end towards the opposing enlarged end.

The pressing wedge C is configured so that it can be axially slotted with clearance through the window B3 of the base block B along an insertion direction parallel to (and coinciding with) the aforesaid flanking direction.

For example, the maximum height of the pressing wedge C is less than the height of the window B3 (i.e. the edge of the bridge B2 from the visible surface of the flanked tiles T).

The edge of the bridge B2 is adapted to engage the teeth substantially in a pop-up manner during the axial insertion of the pressing wedge C inside the window B3 along the insertion direction.

The pressing wedge C is adapted to be slotted into the window by means of a direct axial thrust parallel to the insertion direction from the side of maximum height of the pressing wedge C and to slide, with the lower surface resting (directly or by means of an anti-friction plate) on the visible surfaces of the tiles T placed side by side and resting on the rest plane defined by the base B1 of the base block B.

During this insertion, the upper surface of the pressing wedge C comes into forced contact with the edge of the bridge B2 and the same pressing wedge C is pressed against both tiles T, which are on opposite sides of the bridge B3, acting to level them.

The levelling spacer system comprises, for the application of a floor, a plurality of pressing wedges C, as described above, e.g. in a number equal to the number of base blocks B.

The tool 10 is configured to facilitate and/or assist the insertion of the pressing wedge C into the window B3 (e.g. after an initial manual insertion of the same), in order to move the actual levelling of the tiles T.

In order to do so, the application system provides that the through opening 420 of the forked free end of the slider 40 is arranged aligned, along the insertion direction, with the window B3 by a first part of the base block B, i.e. the distal part by the handgrip 20.

In practice, the rear main face of the abutment plate 42 (in which the through opening 420 is made) of the slider 40 is placed in contact with a face of the bridge B2 distal from the handgrip 20.

At the same time, the thruster 50 is arranged on the opposite side of the slider 40 with respect to the window B2 of the base block B, so that the thrusting direction of the thruster 50 is substantially parallel to the insertion direction.

More in detail, the thruster 50 is aligned along the insertion direction behind (the maximum height end of) the pressing wedge C, so that the mechanical actuator 60, when commanded to switch from the contracted configuration to the extended configuration, actuates the thruster 50 from the withdrawn position to the advanced position causing the thrust of the pressing wedge C along the insertion direction, inside the window B3 of the base block B (and of the through opening 420 of the slider 40, which acts as an abutment for the bridge B2 which allows the forced insertion of the pressing wedge C in the window B2 and to exert the levelling action).

The axial position of the slider 40 (or the distance between the slider 40 and the thruster 50 when the latter is in its advanced position) is determined (by the user) as a function of the thickness of the tiles T and the height of the B3 window of the base B.

The invention thus conceived is susceptible to many modifications and variants, all falling within the same inventive concept.

Moreover, all the details can be replaced by other technically equivalent elements. In practice, any materials and also any contingent shapes and sizes may be used, depending on the needs, without departing from the scope of protection of the following claims.

The invention claimed is:

1. A tool for the application of pressing wedges in wedge-type levelling spacer systems used in the application of tiles and that are equipped with a base block and a pressing wedge, wherein the tool comprises:

a handgrip comprising a front end from which projects a support rod having a longitudinal axis;

a slider constrained to the support rod and at least partially delimiting a through opening configured to slidably receive at least one axial segment of the pressing wedge;

a thruster associated with the handgrip in a movable manner at least along a thrusting direction parallel to the longitudinal axis of the support rod between an advanced position, wherein the thruster is proximal to the slider, and a withdrawn position, wherein the thruster is distal from the slider; and a mechanical actuator associated with the handgrip and configured to actuate the thruster at least from the withdrawn position to the advanced position, wherein the handgrip has an inner chamber, and wherein the mechanical actuator is chosen from the group constituted by a pneumatic actuator and an electric actuator and comprises a fixed body rigidly fixed to the handgrip within the inner chamber thereof.

2. The tool according to claim 1, wherein the mechanical actuator further comprises moveable body projecting rigidly fixed to the thruster and configured to at least partially protrude from the handgrip.

3. The tool according to claim 1, which comprises a control device associated externally with the handgrip, wherein the control device is configured to activate, upon manual command, the mechanical actuator.

4. The tool according to claim 3, which comprises a selector device arranged inside the handgrip and connected to the mechanical actuator, wherein the selector device is operable between an open configuration and a closed configuration by the control device.

5. The tool according to claim 1, wherein the mechanical actuator is a pneumatic actuator.

6. The tool according to claim 5, wherein the mechanical actuator comprises a pneumatic connector configured to at least partially protrude from the handgrip and to be connected to a source of compressed air.

7. The tool according to claim 6, wherein the source of compressed air comprises an accumulation tank, wherein the compressed air in the accumulation tank has a maximum pressure greater than 10 bar.

8. The tool according to claim 1, wherein the mechanical actuator is an electric actuator.

9. The tool according to claim 8, which comprises an electric power source arranged at least partially inside the handgrip and electrically connected to the mechanical actuator for the electrical powering thereof.

10. The tool according to claim 8, which comprises an electric connector configured to at least partially protrude from the handgrip and to be connected to a remote electrical power source.

11. The tool according to claim 1, wherein the thruster is movable to slide along the thrusting direction parallel to the longitudinal axis of the support rod and the mechanical actuator is a linear actuator.

12. A laying and levelling system of tiles that comprises:

a levelling spacer system equipped with one or more base blocks and one or more pressing wedges each of which is configured to be slotted in a window of a base block along an insertion direction;

a tool according to claim 1, wherein the through opening of the forked free end of the slider is configured to be arranged aligned, along the insertion direction, with the window by the base block on a first side thereof and the thruster is configured to be arranged on the opposite side of the slider with respect to the window of the base block behind the pressing wedge, with the thrusting direction substantially parallel to the insertion direction, so that the mechanical actuator, when it actuates the thruster from the withdrawn position to the advanced position, causes the thrusting of the pressing wedge by the thruster, along the insertion direction, inside the window of the base block.

13. The tool according to claim 1, wherein the handgrip comprises a rest and/or abutment and/or reference appendage defined in proximity to or at a rear end of the handgrip, wherein a lower free end of the thruster distal from the support rod is substantially coplanar to the lower free end of the appendage and wherein the lower free end of the slider distal from the support rod is, in turn, co-planar to the lower free end of the thruster and to the lower free end of the appendage.

14. The tool according to claim 1, wherein the mechanical actuator is configured to actuate the movement of the thruster, in both movement directions, alternatively between the withdrawn position and the advanced position.

15. A tool for the application of pressing wedges in wedge-type levelling spacer systems used in the application of tiles and that are equipped with a base block and a pressing wedge, wherein the tool comprises:

a handgrip comprising a front end from which projects a support rod having a longitudinal axis;

a slider constrained to the support rod and at least partially delimiting a through opening configured to slidably receive at least one axial segment of the pressing wedge;

a thruster associated with the handgrip in a movable manner at least along a thrusting direction parallel to the longitudinal axis of the support rod between an advanced position, wherein the thruster is proximal to the slider, and a withdrawn position, wherein the thruster is distal from the slider;

a mechanical actuator associated with the handgrip and configured to actuate the thruster at least from the withdrawn position to the advanced position;

a control device associated externally with the handgrip, wherein the control device is configured to activate, upon manual command, the mechanical actuator; and a selector device connected to the mechanical actuator, wherein the selector device is operable between an open configuration and a closed configuration by the control device.

16. The tool according to claim 15, wherein the selector device is arranged inside the handgrip.

17. A tool for the application of pressing wedges in wedge-type levelling spacer systems used in the application of tiles and that are equipped with a base block and a pressing wedge, wherein the tool comprises:

a handgrip comprising a front end from which projects a support rod having a longitudinal axis;

a slider constrained to the support rod and at least partially delimiting a through opening configured to slidably receive at least one axial segment of the pressing wedge;

a thruster associated with the handgrip in a movable manner at least along a thrusting direction parallel to the longitudinal axis of the support rod between an advanced position, wherein the thruster is proximal to the slider, and a withdrawn position, wherein the thruster is distal from the slider;

a mechanical actuator associated with the handgrip and configured to actuate the thruster at least from the withdrawn position to the advanced position, wherein the mechanical actuator is an electric actuator; and an electric power source arranged at least partially inside the handgrip and electrically connected to the mechanical actuator for the electrical powering thereof.

18. The tool according to claim 17, which comprises an electric connector configured to at least partially protrude from the handgrip and to be connected to a remote electrical power source.

* * * * *